US005166670A

United States Patent [19]

Takeda et al.

[11] Patent Number: 5,166,670

[45] Date of Patent: Nov. 24, 1992

[54] COLUMN ELECTRODE DRIVING CIRCUIT FOR A DISPLAY APPARATUS

[75] Inventors: Shiro Takeda, Tenri; Takafumi Kawaguchi; Makoto Takeda, both of Nara, all of Japan

[73] Assignee: Sharp Kabushiki Kaisha, Osaka, Japan

[21] Appl. No.: 634,591

[22] Filed: Dec. 27, 1990

[30] Foreign Application Priority Data

Dec. 27, 1989 [JP] Japan ..... 1-342119

[51] Int. Cl.[5] ..... G09G 3/36

[52] U.S. Cl. ..... 340/784; 340/718; 340/800; 340/805; 340/811

[58] Field of Search ..... 340/718, 719, 784, 789, 340/800, 802, 803, 805, 811, 726; 377/69

[56] References Cited

U.S. PATENT DOCUMENTS

| | | | |
|---|---|---|---|
| 3,348,069 | 10/1967 | Petschauer | 377/69 |
| 3,378,876 | 4/1968 | Goldberg et al. | 377/69 |
| 4,365,242 | 12/1982 | Yasuda et al. | 340/784 |
| 4,799,057 | 1/1989 | Takeda et al. | 340/784 |
| 4,801,933 | 1/1989 | Yamamoto et al. | 340/784 |
| 4,825,202 | 4/1989 | Dijon et al. | 340/784 |

FOREIGN PATENT DOCUMENTS

| | | |
|---|---|---|
| 53-68514 | 6/1978 | Japan . |
| 1-150197 | 6/1989 | Japan . |

*Primary Examiner*—Jeffery A. Brier
*Assistant Examiner*—Jick Chin

[57] ABSTRACT

An improved column electrode driving circuit can drive a matrix type display apparatus without necessitating that digital signals be transmitted between partial column electrode driving circuits. Each of the partial column electrode driving circuits is allocated with a number. In each of the partial column electrode driving circuits, a shift register shifts a sample signal to sequentially output it from a plurality of outputs. At each time when a predetermined number of clock pulses have been counted, a count signal is produced. When the shift direction is set to the right direction, a signal indicating the allocated number is produced. When the shift direction is set to the left direction, a signal indicating a number, which is obtained by subtracting the allocated number from a specified number, is produced. When this number and the clock pulse count number satisfy a predetermined relationship, the sample signal is output.

12 Claims, 9 Drawing Sheets

COLUMN ELECTRODE DRIVING CIRCUIT FOR A DISPLAY APPARATUS

BACKGROUND OF THE INVENTION

1. Field of the Invention

This invention relates to a column electrode driving circuit for a display apparatus, and more particularly to a column electrode driving circuit for a matrix type display apparatus.

2. Description of the Prior Art

As a typical example of a matrix type display device, a matrix type liquid crystal display (LCD) apparatus is shown in FIG. 6. The LCD apparatus of FIG. 6 comprises an LCD panel 61 having: a plurality of row electrodes 61*a* which are disposed on a substrate parallel to one another; and a plurality of column electrodes 61*b* which intersect the row electrodes 61*a*. A picture element (pixel) electrode 61*c* and a thin film transistor. (TFT) 61*d* which functions as a switching element, pair is disposed at each crossing of the row electrodes 61*a* and the column electrodes 61*b*. The LCD panel 61 is driven by a row electrode driving circuit 62 and column electrode driving circuit 63. The row electrode driving circuit 62 produces scanning pulses which are in turn supplied to the row electrodes 61*a* to sequentially turn on each row of the switching transistors 61*d*. The column electrode driving circuit 63 produces voltage signals which are applied to the pixel electrodes 61*c* through the column electrodes 61*b*. A control circuit 64 controls the operations of the row electrode driving circuit 62 and the column electrode driving circuit 63.

As shown in FIG. 7, the column electrode driving circuit 63 comprises a shift register circuit 71, a sample and hold circuit 72, and a buffer circuit 73. The shift register circuit 71 shifts a sample signal D in accordance with clock pulses $\phi$ and sequentially outputs the sample signal to lines $q_1, q_2, \ldots, q_n$. The sample and hold circuit 72 samples and holds a video signal V in accordance with sample signals output to the lines $q_1, q_2, \ldots, q_n$. The buffer circuit 73 simulataneously outputs the voltage signals held in the sample and hold circuit 72 to the column electrodes 61*b*, as voltage signals $Q_1, Q_2, \ldots, Q_n$, at the time when an output timing signal T is input.

The operation of the column electrode driving circuit 63 will be described with reference to FIG. 8. After the input of the sample signal D, sample signals are sequentially output to the lines $q_1, q_2, \ldots, q_j, \ldots$ from the shift register circuit 71. The sample and hold circuit 72 samples instantaneous voltages $V_{i1}, \ldots, V_{ij}, \ldots$ of the video signal V in accordance with these sample signals. At the time when the sampling of one row has been completed, the output timing signal T is input, and the buffer circuit 73 operates.

If the number of the column electrodes 61*b* to be driven is large, the column electrode driving circuit 63 is usually comprised of a plurality of partial column electrode driving circuits 90, each corresponding to a portion of the column electrodes 61*b*, as shown in FIG. 9. Each of the partial column electrode driving circuits 90 is integrated in one LSI chip, and is provided with a shift register circuit 91, a sample and hold circuit 92, and a buffer circuit 93. The shift register circuit 91, sample and hold circuit 92 and buffer circuit 93 may have the same structure as the shift register circuit 71, sample and hold circuit 72 and buffer circuit 73, respectively, except that the number of column electrodes to drive is different. It is necessary for the shift register circuits 91 in all of the partial column electrode driving circuits 90, as a whole, to continuously perform sampling and holding operations as a single shift register circuit. Therefore the output of the final step of the shift register circuit 91 in each partial column electrode driving circuit 90 is supplied to the shift register circuit 91 in the next partial column electrode driving circuit 90.

In the above mentioned column electrode driving circuit 63, digital signals and analog signals both exist. Therefore, noises from the digital signals which are mixed with the analog signal become a problem. When such a driving circuit is applied to a display apparatus in a small sized television display device, in addition to a direct effect via power lines and signal lines etc., high frequency noises radiated into the air are picked up by an antenna of the device, causing disturbance in the displayed image. Furthermore, at the instant when the level of the digital signals changes, currents of a comparatively large amount flow. As a result, a linear disturbance synchronized with the change in the digital signal level is generated on the display of the display apparatus.

With respect to disturbance in the image caused by a digital signal, counter measures can be considered such as digital signals, which undergo changes in level, being used as little as possible within the column electrode drive circuit during the period when sampling is performed. Alternatively, a circuit for eliminating the high frequency components of the signal can be provided in a location as close as possible to the supply terminal of the digital signal for the column electrode driving circuit.

However, in such a column electrode driving circuit wherein a plurality of LSIs are connected in a cascade, the level of digital signals transmitted between the LSIs changes during the sampling operation, thereby causing the image disturbance. Furthermore, since LSIs are usually mounted in a high density, there are many cases where it is impossible to carry out effective noise countermeasures in the vicinity of the LSIs.

SUMMARY OF THE INVENTION

The column electrode driving circuit of this invention, which overcomes the above-discussed and numerous other disadvantages and deficiencies of the prior art, comprises a plurality of partial column electrode driving circuits which respectively drive groups of column electrodes of said display apparatus. Each of said partial column electrode driving circuits is allocated with a number, and comprises: shift register means for shifting a sample signal to sequentially output said sample signal from a plurality of outputs, the shifting direction being changeable in accordance with a shift direction control signal; count means for counting clock pulses, and for producing a count signal at each time when a predetermined number of clock pulses have been counted; switch means for, when said shift direction is set to a first direction, producing a signal indicating said allocated number, and for, when said shift direction is set to a second direction which is opposite to said first direction, producing a signal indicating a number which is obtained by subtracting said allocated number from a specified number; sample signal output means for, when said number output from said switch means and the number of said count signals satisfy a predetermined relationship, outputting said sample signal; and sample and hold means for sampling and holding input video signals.

In a preferred embodiment, said display apparatus is a matrix type liquid crystal display apparatus.

In another preferred embodiment, the predetermined number of clock pulses is equal to the number of steps of said shift register means.

In a further preferred embodiment, the allocated number of one of the partial column electrode driving circuits corresponding to the position of said partial column electrode driving circuit in the arrangement of the partial column electrode driving circuits.

In a still further preferred embodiment, the specified number relates to the number of the partial column electrode driving circuits.

Thus, the invention described herein makes possible the objectives of:

(1) providing a column electrode driving circuit which can drive a display apparatus without impairing the display quality;

(2) providing a column electrode driving circuit which can drive a display apparatus without requiring digital signals transmitted between partial column electrode driving circuits; and (3) providing a column electrode driving circuit which can drive a display apparatus without producing noises caused by digital signals transmitted between partial electrode driving circuits.

These and further objects of the present invention will become more readily apparent from their understanding of the preferred embodiments described below with reference to the following drawing figures.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 2:
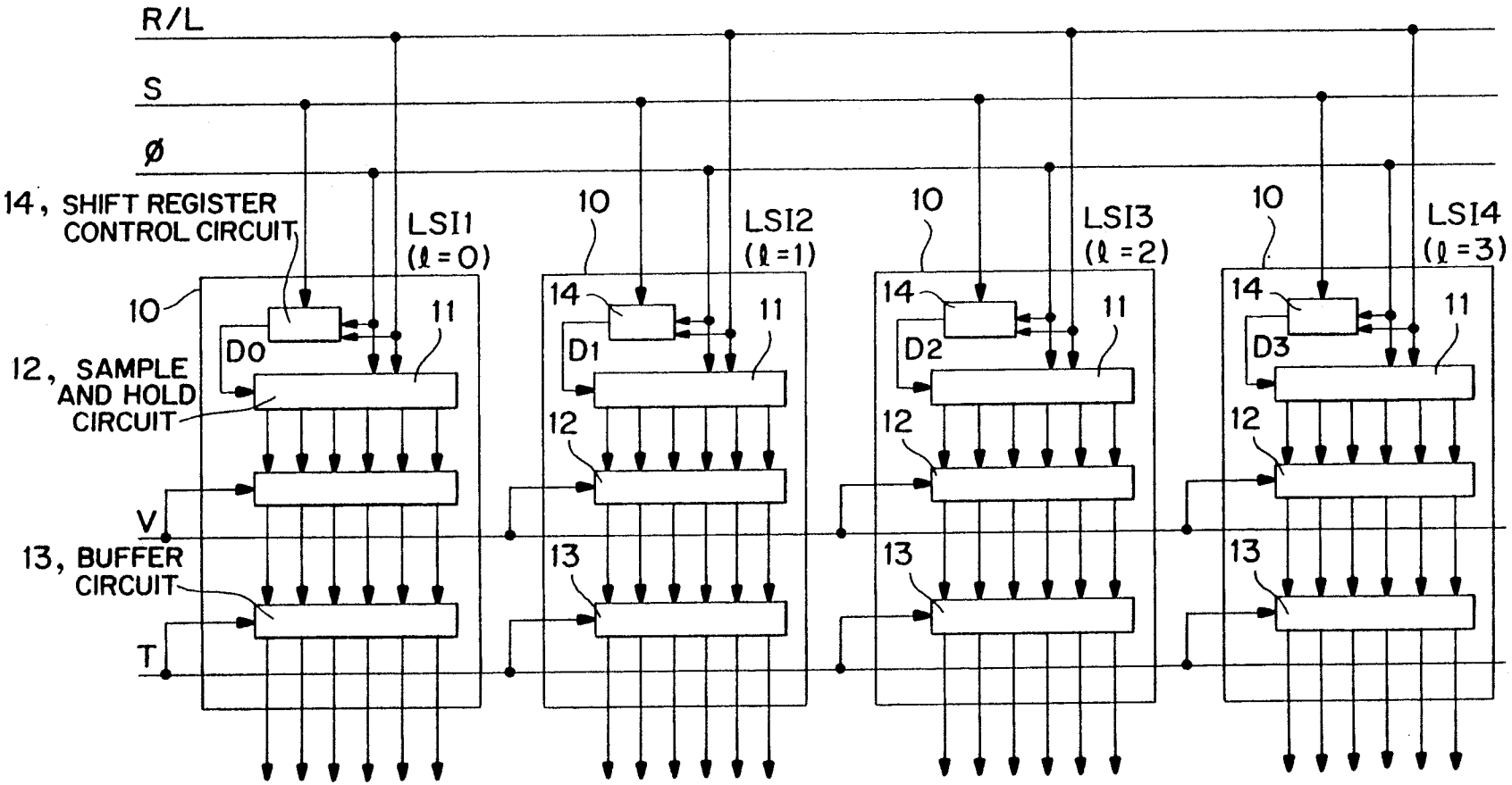
FIG. 2 is a block diagram illustrating the column electrode driving circuit according to the invention.
Figure 6:
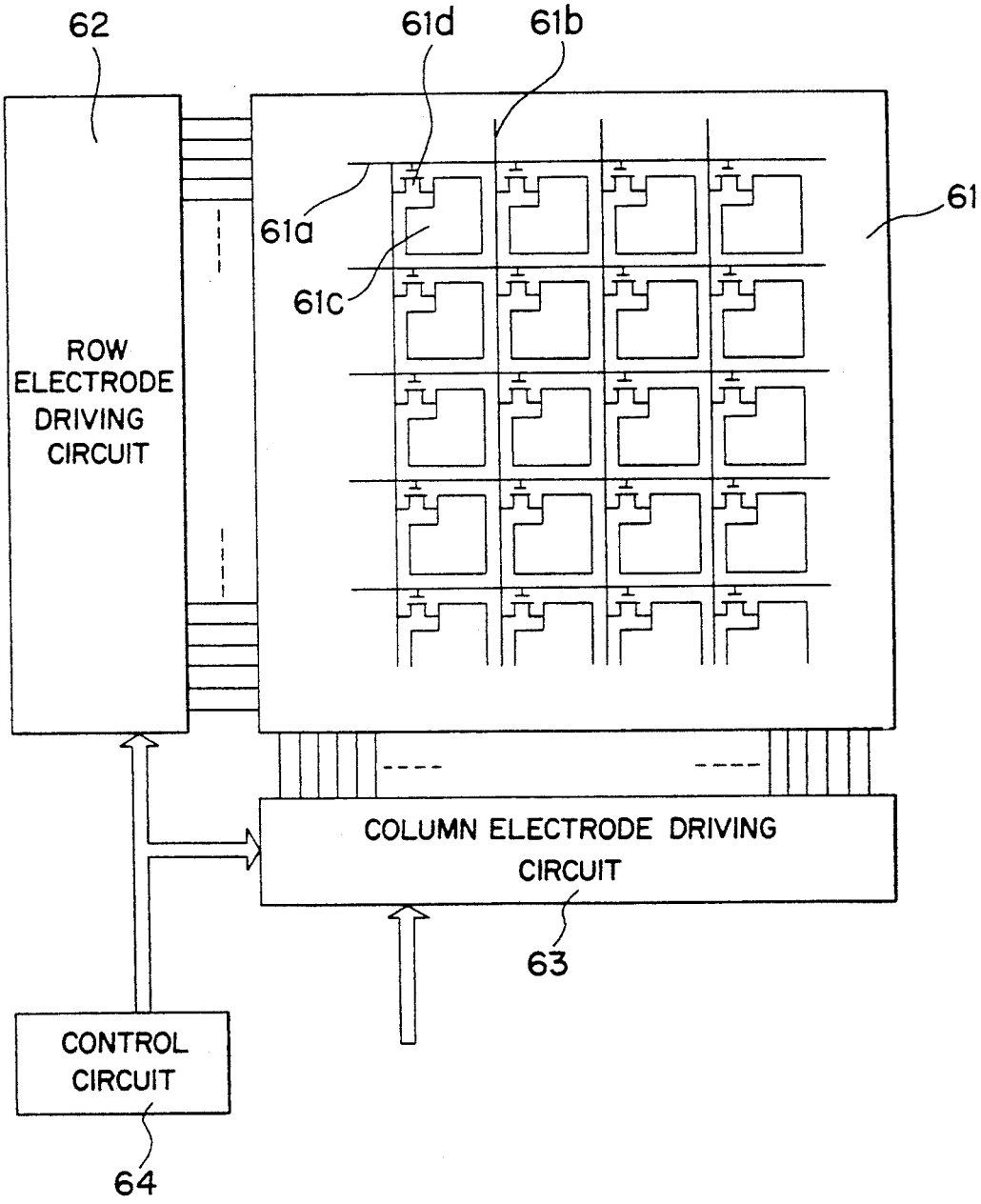
FIG. 6 PRIOR ART
FIG. 6 diagrammatically illustrates an LCD apparatus.
Figure 7:
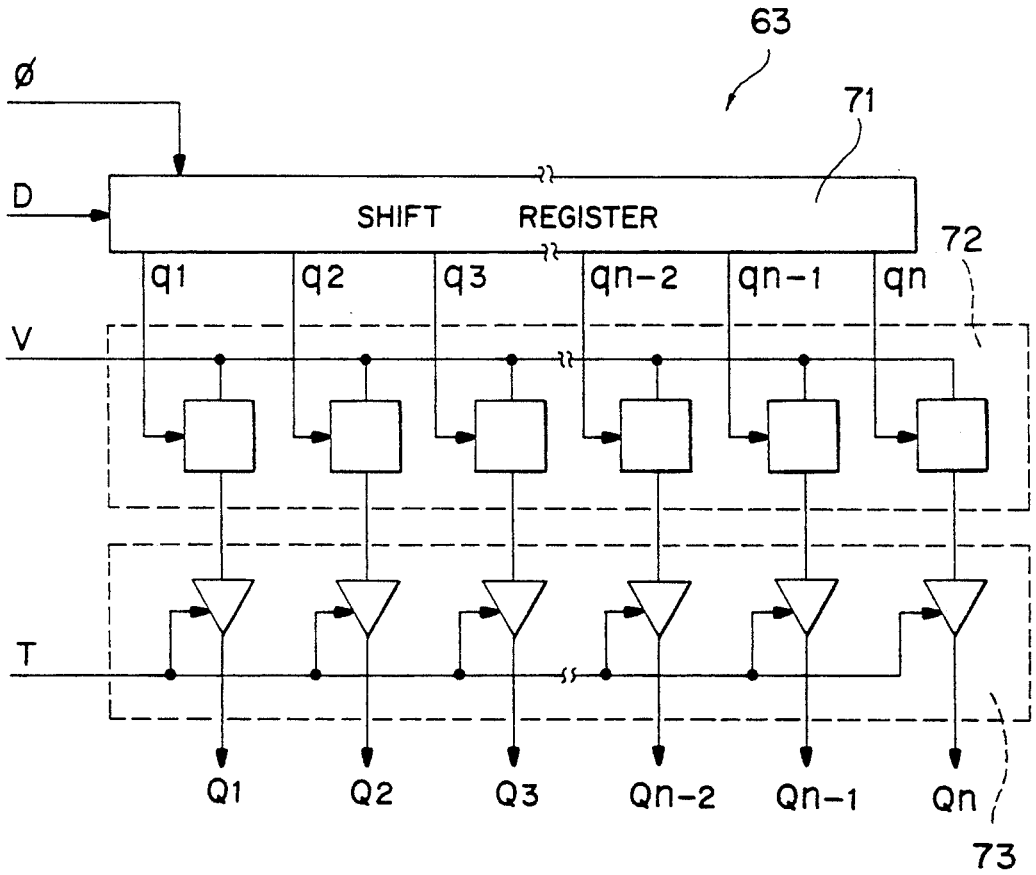
FIG. 7 PRIOR ART
FIG. 7 is a block diagram illustrating a column electrode driving circuit of the prior art.
Figure 8:
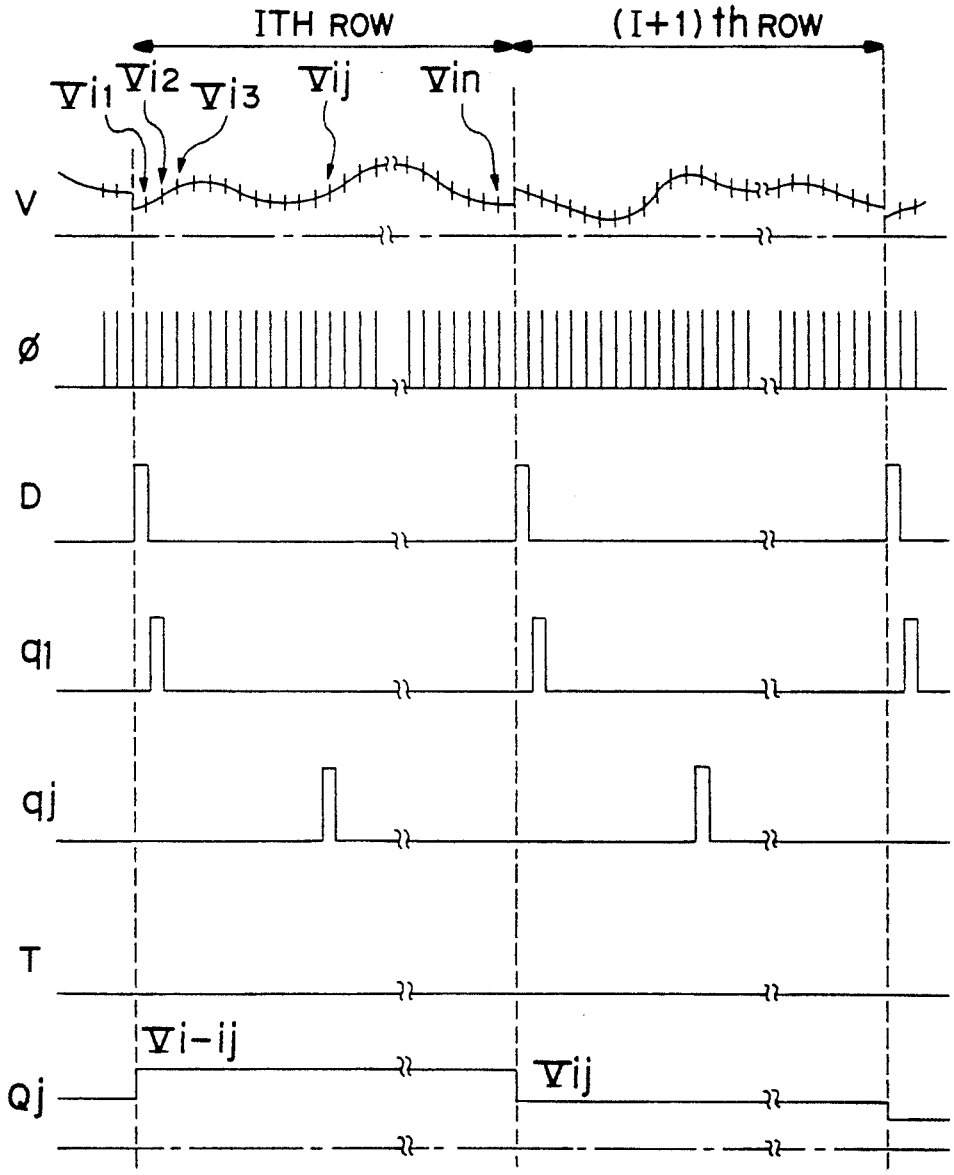
FIG. 8 PRIOR ART
FIG. 8 is a timing chart illustrating the operation of a partial column electrode driving circuit used in the circuit of FIG. 7.
Figure 9:
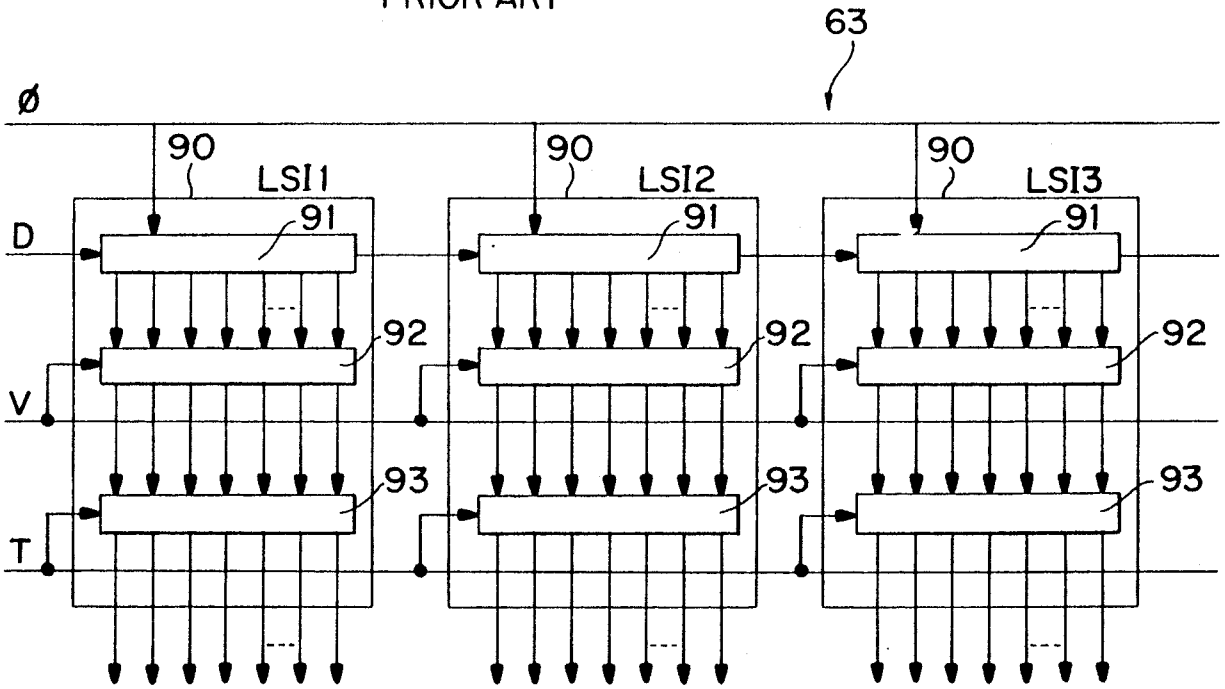
FIG. 9 PRIOR ART
FIG. 9 is a block diagram illustrating partial column electrode driving circuit used in the circuit of FIG. 7.
Figure 2:
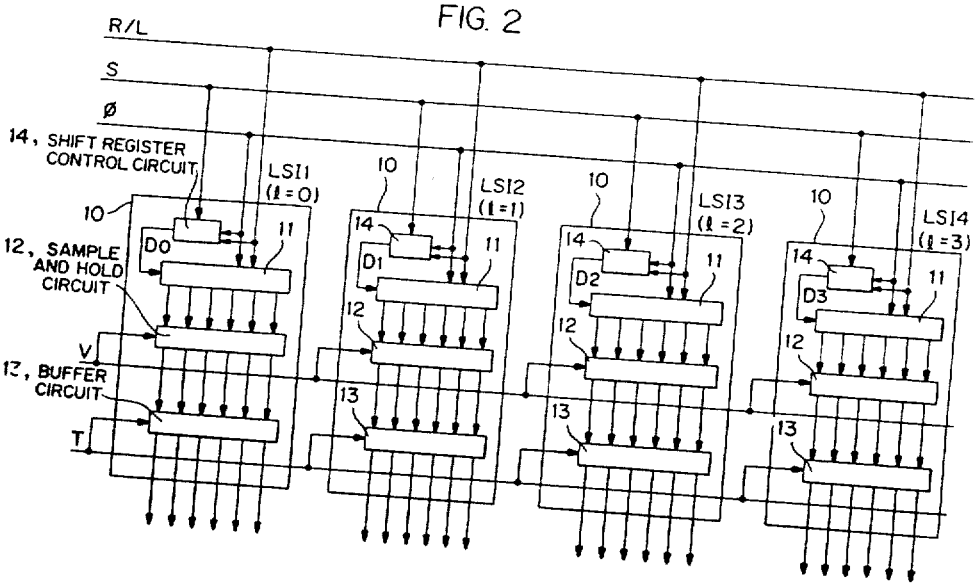
Figure 4:
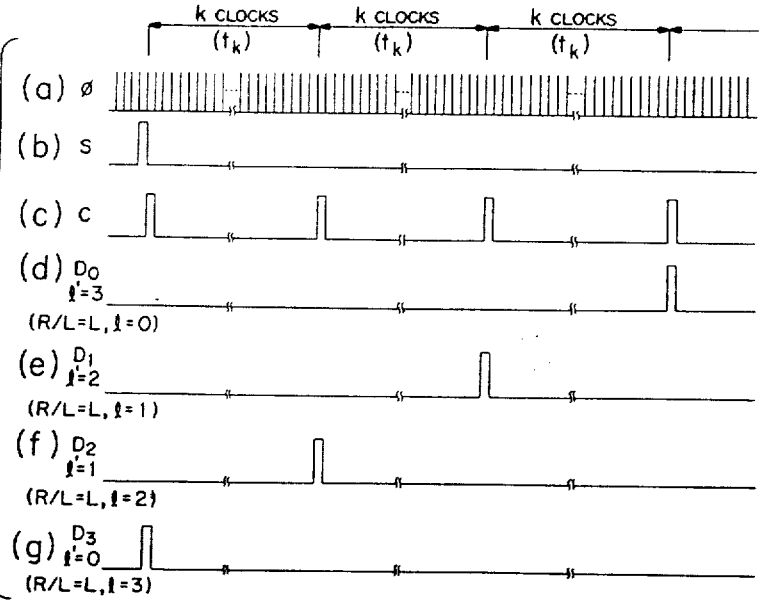

FIG. 2 illustrates a column electrode driving circuit according to the invention. The circuit of FIG. 2 can drive the LCD apparatus shown in FIG. 6, and includes four partial column electrode driving circuits 10, each of which corresponds to k number of column electrodes in the LCD apparatus. The number of partial column electrode driving circuits 10, and the number of column electrodes which correspond to one of the partial column electrode driving circuit 10 are not restricted to the above, and can be selected arbitrarily. Each of the partial column electrode driving circuits 10 is integrated into one LSI chip, and includes a shift register circuit 11, a sample and hold circuit 12, a buffer circuit 13 and a shift register control circuit 14. Clock pulses $\phi$ and shift direction control signal R/L are commonly supplied to the shift register circuits 11 and shift register control circuits 14 in all of the partial column electrode driving circuits 10. A start signal S is further supplied to the shift register control circuits 14. Furthermore, a video signal V and an output timing signal T are input respectively to the sample and hold circuits 12 and buffer circuits 13 in the partial column electrode driving circuits 10.

Figure 1:
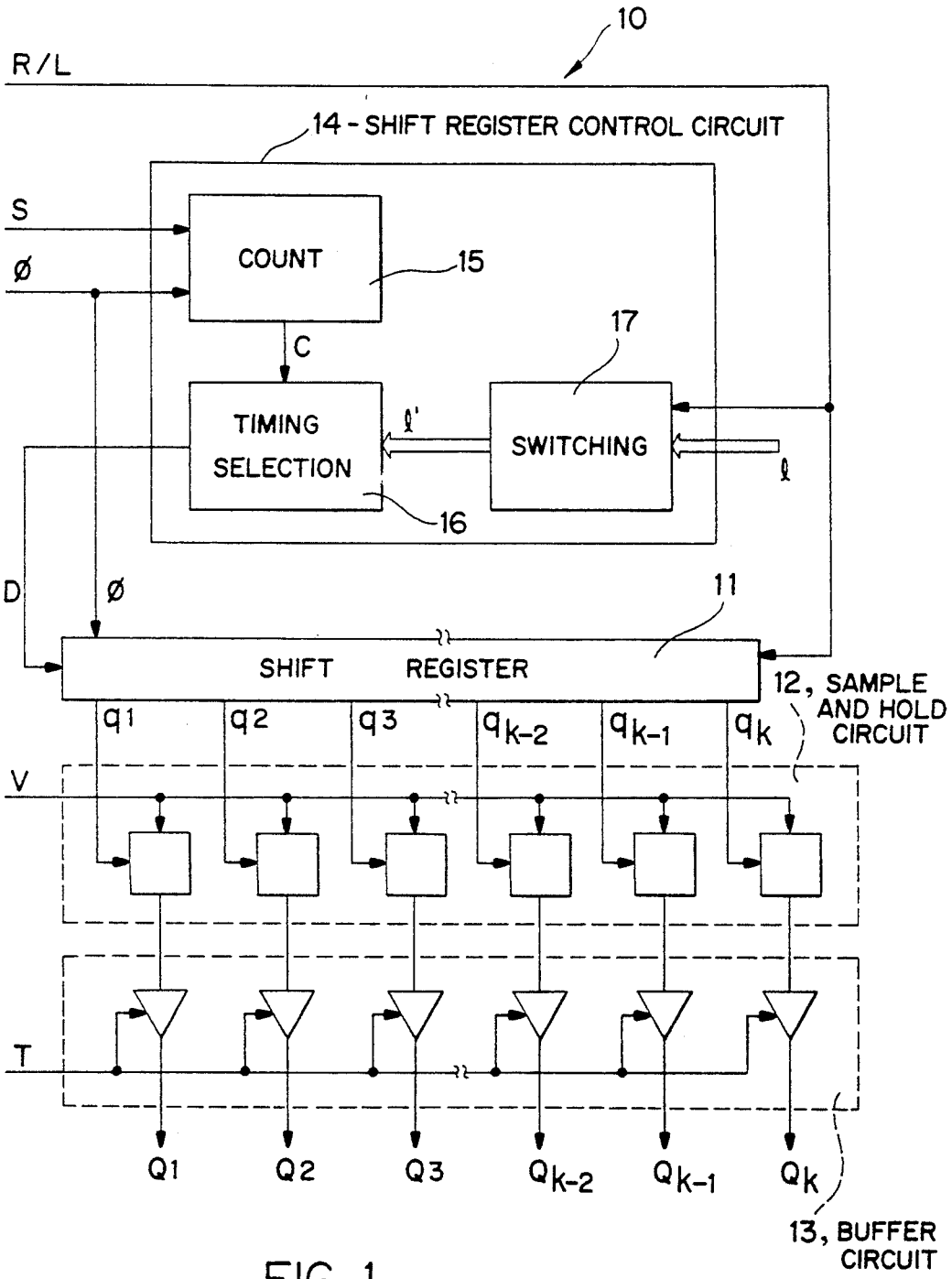
FIG. 1 is a block diagram illustrating a partial column electrode driving circuit used in a column electrode driving circuit according to the invention.

FIG. 1 shows one of the partial column electrode driving circuits 10 in more detail. The sample and hold circuit 12 and buffer circuit 13 are constructed in the same manner as those used in the prior art. The shift register circuit 11 is structured so that the shift direction reverses in response to the shift direction control signal R/L. When the shift direction control signal R/L is right (R), the shifting operation toward the right (normal shifting) is performed, and the sample signals are sequentially output from the lines $q_1$, $q_2$, . . . , in this order. When the shift direction control signal R/L is left (L), the shifting operation toward the left (reverse shifting) is performed, and the sample signals are sequentially output from the lines $q_k$, $q_{k-1}$, . . . , in this order. In the prior art, the sample signal D which is input to the shift register circuit 11, is supplied from outside of the partial column electrode driving circuit 10. By contrast, in this embodiment, the sample signal D is generated by the shift register control circuit 14.

The shift register control circuit 14 includes a count circuit 15, a timing selection circuit 16, and a switching circuit 17. The count circuit 15 supplies a count signal C to the timing selection circuit 16 immediately after receiving the start signal S, and every time k clock pulses $\phi$ (k is the number of steps in the shift register circuit 11) are counted after the input of the start signal S. The switching circuit 17 supplies externally established data l, when the shift direction control signal R/L is R, and data (n−1−l), when the shift direction control signal R/L is L, to the timing selection circuit 16. Here, n is the total number of the partial column electrode driving circuits 10, and in this embodiment n=4. As shown in FIG. 2, l is a value assigned to each of the partial column electrode driving circuits 10, based upon the arrangement order in which the partial column electrode driving circuits 10 are disposed. Data supplied from the switching circuit 17 to the timing selection circuit 16 is indicated by l' in FIG. 1. In other words, when the shift direction control signal R/L is R, l'=l, and when the shift direction control signal R/L is L, l'=(n−1−l). The timing selection circuit 16 outputs the sample signal D to the shift register circuit 11 when the number of count signals C which have been input is equal to, l'. wherein the first count signal produced upon receipt of the start signal S is equal to the zeroth count signal and the next count signal output is equal to the first.

Figure 3:
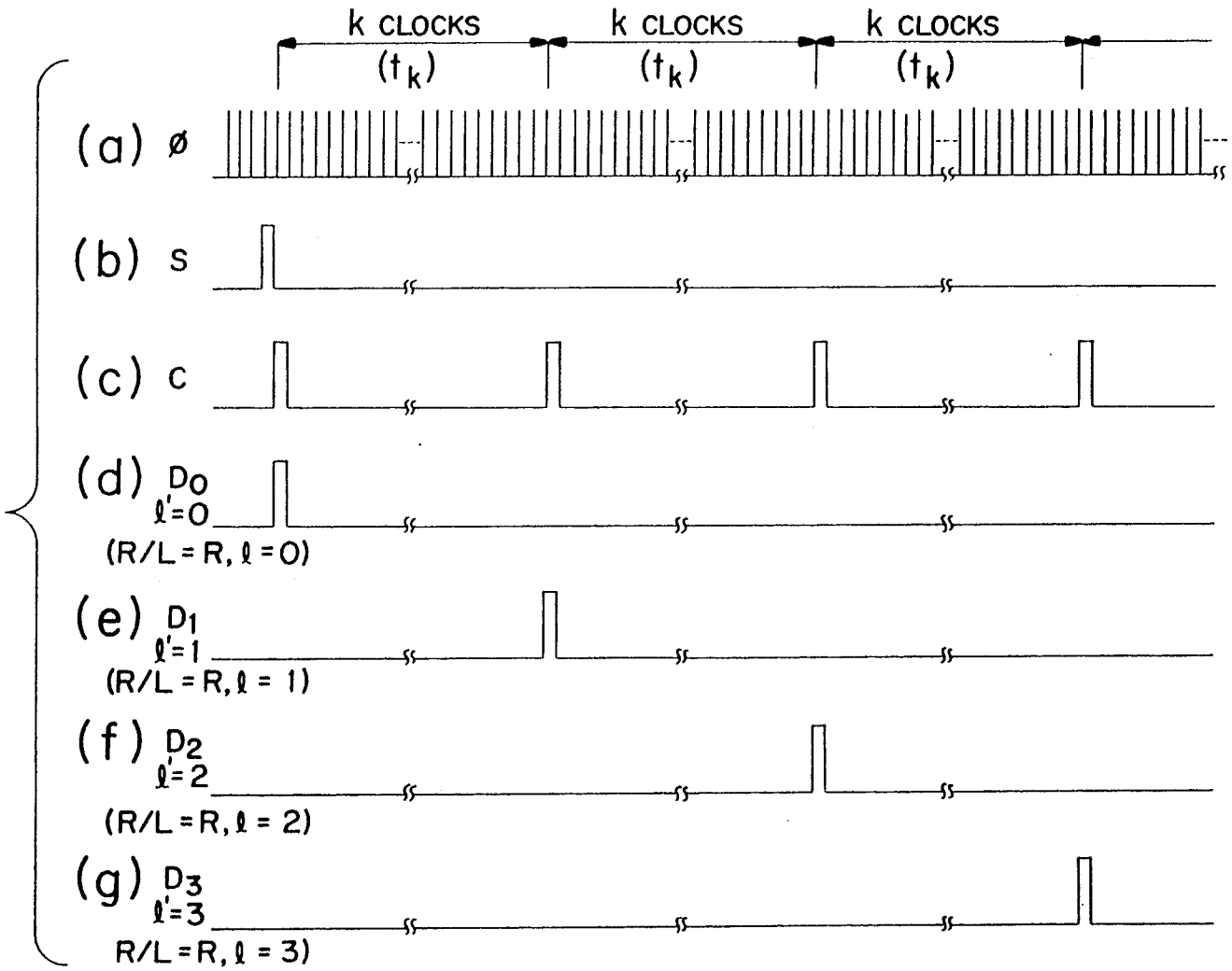
FIGS. 3 and 4 are timing charts illustrating the operation of the column electrode driving circuit of FIG. 2.

The operation of this embodiment will be described with reference to FIG. 3 which is the timing chart for a case in which the shift direction control signal R/l is R. Immediately after receiving the start signal S ((b) of FIG. 3) which directs the commencement of the sampling operation, the count circuit 15 generates one count signal C ((c) of FIG. 3). Following this, one count signal C is generated every time k number of clock pulses $\phi$ ((a) of FIG. 3) are input. The time interval $t_k$ for generating the count signal C is equal to the period of time required for shifting the sample signal D through all of the steps of the shift register circuit 11. In (d) to (g) of FIG. 3, subscripts 0 to 3 are added to the sample signal D in accordance with the values (0 to 3) of the data l which are assigned to the partial column electrode driving circuits 10, in the same way as in FIG. 2.

As seen from the above description, according to this embodiment, the shift register control circuit 14 can generate the sample signal D which is directed to the shift register circuit 11 within the same partial column electrode driving circuit 10, with proper timing based upon the data l. In this embodiment the sample signals $D_1$, $d_2$ and $D_3$ are generated with the same timing as the digital signals transmitted between partial column electrode driving circuits in the prior art. Therefore, the digital signals which are transmitted between the partical column electrode driving circuits in a column electrode driving circuit of the prior art are not necessary, and thus it is possible to avoid image disturbance due to noises from the digital signals. Moreover, the level of the start signal S changes outside of the sampling period, and the start signal S can be generated outside of the LSI which contains the partial column electrode driving circuit 10. Hence, it is possible to easily add a circuit as a noise countermeasure, so that the start signal S does not become a source of image disturbance.

Figure 4:
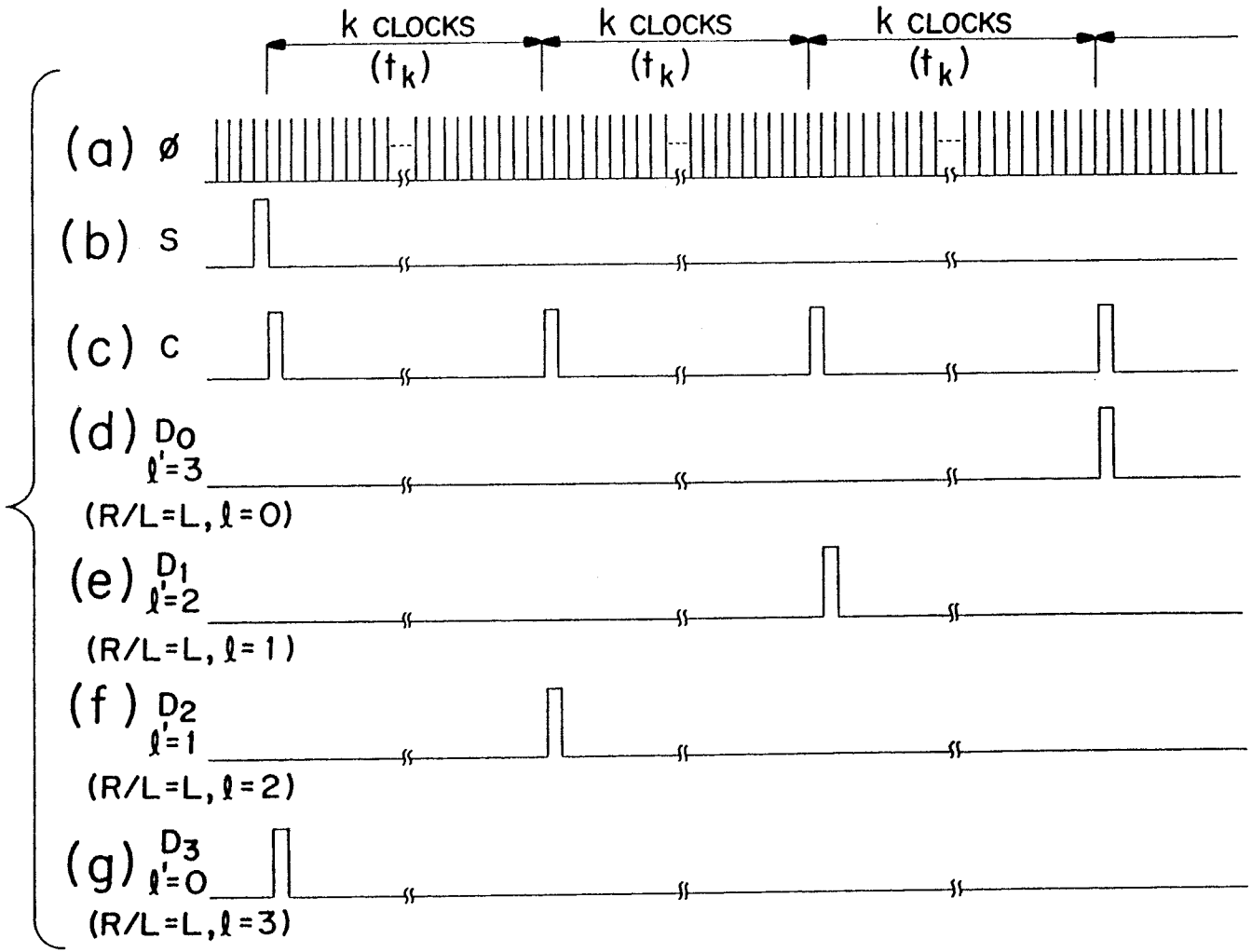

FIG. 4 illustrates the operation of this embodiment in the case where the shift direction control signal R/L is L. When R/L=L, the generation sequence of the sample signals $D_0$ through $D_3$ is opposite to that in the case where R/L=R, as is shown in (d) to (g) of FIG. 4. Furthermore, although not illustrated, the direction in which the sample signal D is shifted by the shift register circuit 11 within the partial column electrode driving circuit 10 is also opposite to that in the case where R/L=R.

Figure 5:
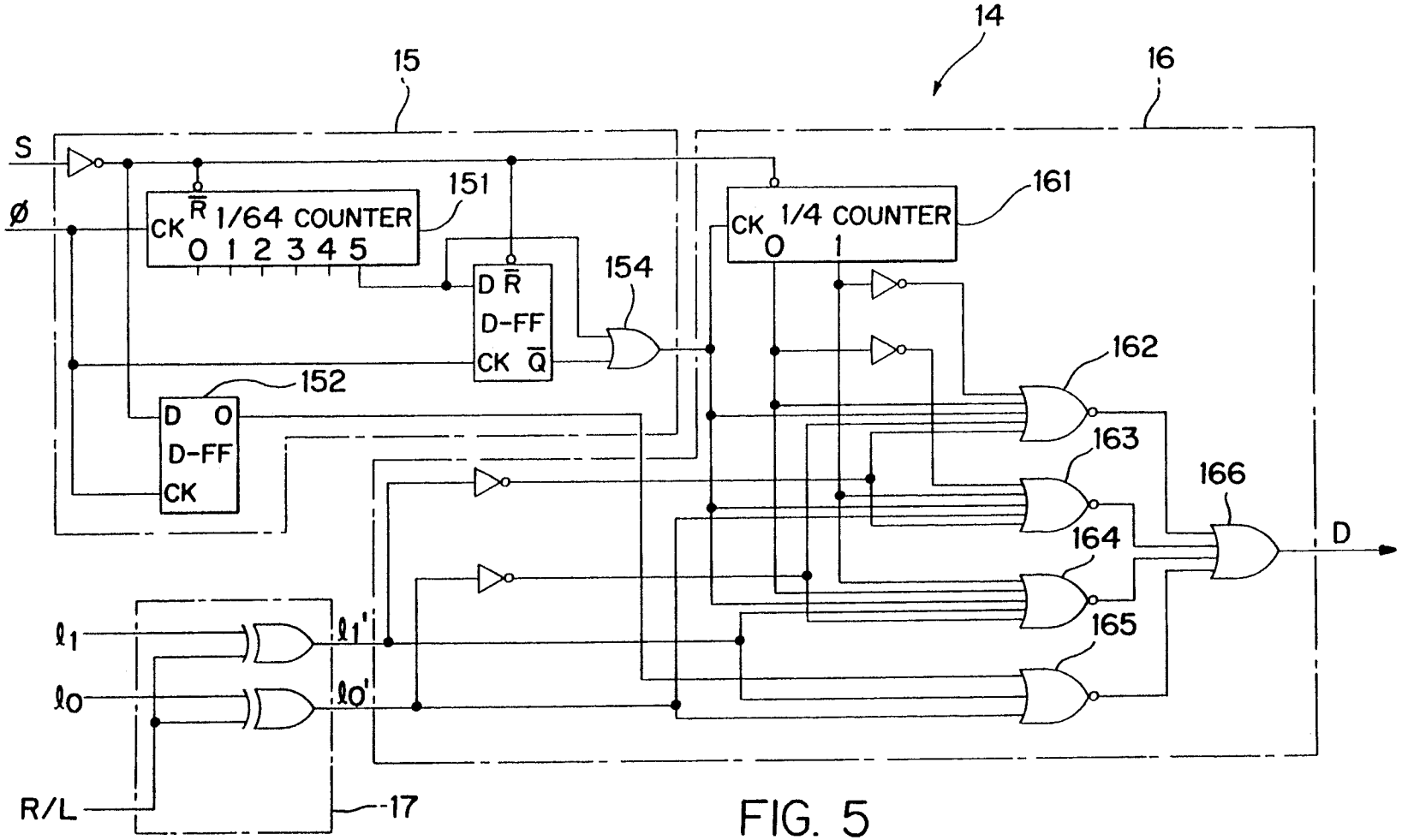
FIG. 5 is a circuit diagram of the partial column electrode driving circuit of FIG. 1.

A circuit diagram of the shift register control circuit 14 is shown in FIG. 5. In the shift register control circuit 14 shown in FIG. 5, the value K is set to 64, data l is expressed with two bits ($l_1$, $l_0$). When the shift direction control signal R/L is R, it has the value of "0". Further, when the shift direction control signal R/L is L, it has the value of "1". The count signal C which is generated immediately after the input of the start signal S is output from a D flip-flop 152. A 1/64 counter 151 counts the clock pulses $\phi$. When the output of the 1/64 counter 151 changes from 63 (=111111) to 0 (=000000), the count signal C is output from an OR gate 154 as the count signal C. The count signal C which is output from the OR gate 154 is counted by a $\frac{1}{4}$ counter 161. When the count signal C is output from the D flip-flop 152 or the OR gate 154, it is determined by the combination or NOR gates 162–165 whether or not the data l' expressed by two bits ($l'_1$, $l'_0$) and supplied from the switching circuit 17 coincide with the output of the $\frac{1}{4}$ counter 161. IF yes, the sample signal D is output from an OR gate 166.

According to this invention, it is not necessary to produce digital signals between partial column electrode driving circuits. In the column electrode driving circuits of the invention, therefore, image disturbance fue to noises resulting from digital signals can be eliminated.

Furthermore, in the column electrode driving circuits of the invention, the sequence of driving column electrodes in a display apparatus can be easily reversed by controlling the shift direction control signal.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. In a column electrode driving circuit for a display apparatus, including a plurality of partial column electrode driving circuits which respectively drive groups of column electrodes of said display apparatus, each of the partial column electrode driving circuits is allocated with a number, and comprises:

shift register means for shifting a sample signal to sequentially output said sample signal from a plurality of outputs, a direction of shifting being changeable in accordance with a shift direction control signal;

count means for counting a plurality of clock pulses, and for producing a count signal upon each counting of a predetermined number of the plurality of clock pulses;

switch means for, when said shift direction is set to a first direction, producing a signal indicating said allocated number, and for, when said shift direction is set to a second direction which is opposite to said first direction, producing a signal indicating a number which is obtained by subtracting said allocated number from a specified number;

sample signal output means for, when said allocated number output from said switch means and the number of produced count signals satisfy a predetermined relationship, outputting said sample signal; and sample and hold means for sampling and holding input video signals in accordance with said output sample signal.

2. A column electrode driving circuit according to claim 1, wherein said display apparatus is a matrix type liquid crystal display apparatus.

3. A column electrode driving circuit according to claim 1, wherein said predetermined number of clock pulses is equal to a number of steps of said shift register means.

4. A column electrode driving circuit according to claim 1, wherein said allocated number of each of said partial column electrode driving circuits corresponds to a position of each partial column electrode driving circuit in an arrangement of said plurality of partial column electrode driving circuits, with respect to other of the plurality of partial column electrode driving circuits.

5. A column electrode driving circuit according to claim 1, wherein said specified number relates to the number of said plurality of partial column electrode driving circuits.

6. A column electrode driving circuit according to claim 1, wherein said predetermined relationship to be satisfied is that of said allocated number output from said switch means being equal to the number of produced count signals.

7. A method for driving each of a plurality of partial column electrode drivers, each allocated a number, in a column electrode driving circuit for a display apparatus, comprising the steps of:

(a) shifting a sample signal to sequentially output the sample signal from a plurality of outputs, a direction of shifting being changeable in accordance with a shift direction control signal;

(b) counting a plurality of clock pulses, and producing a count signal upon each counting of a predetermined number of the plurality of clock pulses;

(c) producing a signal indicating the allocated number, for each of the plurality of partial column electrode drivers, when the shift direction is set to a first direction;

(d) producing a signal indicating a number which is obtained by subtracting the allocated number from a specified number when the shift direction is set to a second direction which is opposite to the first direction;

(e) outputting the sample signal when the allocated number in the produced signal of one of steps (c) and (d) and the number of produced count signals in step (b) satisfy a predetermined relationship;

(f) sampling and holding input video signals in accordance with the output sample signal of step (e).

8. The method of claim 7, wherein the display apparatus is a matrix type liquid crystal display apparatus.

9. The method of claim 7, wherein the predetermined number of clock pulses is equal to a number of steps in a shift register performing the shifting of step (a).

10. The method of claim 7, wherein the allocated number of each of the partial column electrode driving circuits corresponds to a position of each partial column electrode driving circuit in an arrangement of the plurality of partial column electrode driving circuits, with respect to other of the plurality of column electrode driving circuits.

11. The method of claim 7, wherein the specified number relates to the number of the plurality of partial column electrode driving circuits.

12. The method of claim 7, wherein the predetermined relationship to be satisfied is that of the allocated number of one of steps (c) and (d) being equal to the number of produced count signals of step (b).

* * * * *

UNITED STATES PATENT AND TRADEMARK OFFICE

CERTIFICATE OF CORRECTION

PATENT NO. : 5,166,670

DATED : November 24, 1992

INVENTOR(S) : Shiro Takeda, et al

It is certified that error appears in the above-indentified patent and that said Letters Patent is hereby corrected as shown below:

In the drawings, Sheets 2 and 4, consisting of Figs. 2 and 4(e) should be deleted to be replaced with the corrected Figs. 2 and 4(e) as shown on the attached pages.

Signed and Sealed this

Fifth Day of April, 1994

Bruce Lehman

*Attest:*

BRUCE LEHMAN

*Attesting Officer*

*Commissioner of Patents and Trademarks*